United States Patent [19]

Moore

[11] Patent Number: 4,810,220

[45] Date of Patent: Mar. 7, 1989

[54] METHOD FOR MANUFACTURING ELECTRODES FOR A SPARK PLUG

[75] Inventor: David J. Moore, Fostoria, Ohio

[73] Assignee: Allied-Signal Inc., Morristown, N.J.

[21] Appl. No.: 202,284

[22] Filed: Jun. 6, 1988

[51] Int. Cl.[4] ..... H01T 21/02

[52] U.S. Cl. ..... 445/7

[58] Field of Search ..... 445/7; 313/141, 142

[56] References Cited

U.S. PATENT DOCUMENTS

| | | | |
|---|---|---|---|
| 4,488,081 | 12/1984 | Kondo et al. | 313/142 X |
| 4,684,352 | 8/1987 | Clark et al. | 445/7 |
| 4,699,600 | 10/1987 | Kondo | 445/7 |
| 4,700,103 | 10/1987 | Yamaguchi et al. | 313/142 X |

*Primary Examiner*—Kenneth J. Ramsey

*Attorney, Agent, or Firm*—Leo H. McCormick, Jr.; Ken C. Decker

[57] ABSTRACT

A method of manufacturing electrodes for a spark plug (82) whereby a set gap "g" between the tip (12) of a center electrode (80) and a side electrode (62) is substantially uneffected by the exposure to combustive gases in an engine. The center 34 of the tip of the center electrode (80) and center of the side wire (62) are located by a mark. A first sphere (36) of platinum is placed in a fixture and the center (34) on the tip of the center electrode (80) aligned over the first sphere (36). Pressure is applied to the center electrode (80) while electrical current is applied thereto. Thermal energy created at the junction of the axial center (34) and first sphere (36) causes the inconel material in the center electrode (80) to flow and surround the sphere of platinum (36). The side electrode (62) is attached to the metal shell (60) and a second sphere (36') of platinum is similarly metalurgically bonded thereto. The center electrode (80) is placed in a ceramic insulator (30) and retained in a metal shell (60). A gap "g" is thereafter established between surfaces (46 and 72) of the first and second platinum spheres (36, 36'). The fixed gap "g" is maintained for the life of the spark plug (82) since the first and second platinum spheres (36, 36') are substantially uneffected by combustive gases in an engine.

10 Claims, 2 Drawing Sheets

METHOD FOR MANUFACTURING ELECTRODES FOR A SPARK PLUG

The invention relates to a method of making electrodes for a spark plug.

Spark plugs are used in internal combustion engines to ignite the fuel in the combustion chamber. Hence, the electrodes of a spark plug are subject to intense heat and an extremely corrosive atmosphere. To provide some degree of longevity for the spark plug, the side wire and center electrodes are made from a good heat conducting material such as copper surrounded by a jacket of a corrosion resistant material such as nickel.

The manufacture of copper and nickel electrodes for spark plugs has been accomplished in a variety of ways. For instance, U.S. Pat. No. 3,803,892 issued Apr. 16, 1974 and entitled "Method of Producing Spark Plug Center Electrode" describes a method of extruding copper and nickel electrodes from a flat plate of the two materials. U.S. Pat. No. 2,261,436 issued Nov. 4, 1941 and entitled "Spark Plug and Method of Making the Same" illustrates how copper and nickel is swaged into a single long wire and then cut to smaller lengths for use as electrodes in a spark plug. U.S. Pat. No. 3,548,472 issued Dec. 22, 1970 and entitled "Ignition Plug and Method for Manufacturing a Center Electrode for the Same" illustrates a method of cold forming an outer nickel cup shaped sleeve by several steps and then inserting a piece of copper wire into the cup and then lightly pressing the two materials together.

U.S. Pat. No. 3,857,145 issued Dec. 31, 1974 and entitled "Method of Producing Spark Plug Center Electrode" discloses a process whereby a copper center is inserted into a nickel member and attached thereto by a collar portion to assure that an electrical flow path is produced.

The spark plug electrodes produced by the methods disclosed above performed in a satisfactory manner when used in vehicles that were manufactured prior to the implementation of the clean air act of 1977 in the United States. After 1977, with modifications to engines and fuel, the operating temperature of most vehicles increased. As a result of the changes in the engines and fuel, some of the operating components in engines have been subjected to the corrosive effects of exhaust gases. For instance, in distributorless ignition systems, every other spark plug fires in reverse polarity. This causes gap erosion from both the center and side electrodes, depending on whether the spark plug is required to fire in normal or reverse polarity. Erosion of the center electrode is noticed if the spark plug is firing in normal polarity and erosion is noticed on the side electrode if the spark plug is firing in reverse polarity. Thus, even though nickel center wire and side wire electrodes for spark plugs are resistant to most oxides, after a period of time of operating at combustive temperatures and exposive to combustive and recirculation gases corrosion and erosion occurs. Once corrosion and erosion has taken place, the electrical flow path deteriorates which can result in lower fuel efficiency.

U.S. Pat. No. 4,705,486 discloses methods of manufacturing an electrode wherein a platinum disc is welded to the tip of an inconel center wire. Thereafter, the center wire is placed in a die and extruded to a final desired length such that the platinum covers the weld to prevent deterioration of the electrical flow path between the center wire and platinum disc during normal operation when used in a spark plug.

In an effort to reduce the manufacturing cost of an electrode, U.S. Pat No. 4,725,254 discloses a method of manufacture whereby an inconel center wire with a copper core are extruded to a desired length. A platinum ribbon is rolled to a desired thickness and disc punched therefrom. The disc has a cup shape with a peripheral flange. The disc and center wire are placed in a fixture and moved toward each other such that the disc surrounds the tip. When electrical current is passed from the tip of the inconel center wire to the platinum disc an arc occurs which results in the generation of thermal energy. The flow of current continues until the thermal energy is sufficient to melt the inconel at the junction between the tip and disc. Thereafter the electrical current is terminated. A compressive force which is maintained on the disc causes the inconel tip to fuse with the end cap and form a metallurgical bond or joint to complete the manufacture of the electrode.

The methods of manufacturing a center electrode with a platinum cap are satisfactory and meet current operational requirement for vehicles. Unfortunately, the cost of platinum has resulted in the cap costing as much or more than the other components in a spark plug.

In an effort to reduce the cost of the platinum for the electrodes a method has been devised whereby a sphere of platinum is retained by a metalurgically bond between an inconel member and the platinum sphere rather than through an annular lip formed by staking as disclosed in copending U.S. application No. 600-87-010 filed concurrently herewith.

In this invention, the axial center of the tip of the center wire electrode and the center of a surface of the side wire electrode are identified. A sphere of platinum is placed in a fixture and the axial center of the center wire located above the sphere of platinum. A compressive force and electrical current are simultaneously applied to the center wire and sphere. As current flows between the center wire and sphere thermal energy is created at the junction of the axial center and the sphere. The thermal energy cause the material (inconel) in the center wire to melt and flow by gravity around the sphere. When at least one-half of the sphere is coated with inconel, the electric current and compressive forces are terminated.

After the side wire is attached metal shell, the center on the side wire is aligned over the sphere of platinum and a compressive force applied while electrical current flows between the side wire and sphere. Thermal energy is created at the junction of the side wire and sphere which causes the material in the side wire to melt and flow around the sphere. When about one-half of the side wire sphere is covered, the compressive force and electrical current are terminated.

Thereafter the center wire is placed in a ceramic member in the metal shell. A fixed linear distance between the spheres of platinum on the side wire and center electrode is established. This fixed distance remains after operating a spark plug manufactured in this manner in an engine of a vehicle for an extended time period.

An advantage in this method of manufacturing electrodes is the shape of platinum member can accurately be controlled such that a minimum size can be selected to offer protection for an inconel wire without a substantial increase in the cost over conventional spark plugs.

It is an object of this invention to provide a method of manufacturing a spark plug having center and side electrodes with a platinum sphere metallurgically bonded to an inconel electrode such that the linear gap therebetween is not effected by exposure to combustion gases.

A further object of this invention is to provide a method of manufacturing an electrode whereby a platinum sphere is welded to an inconel electrode and a portion of the sphere is flattened to define a protective surface which extends over the weld to establish an electrical conductive flow path that would be substantially uneffected by erosion of the electrode caused by the corrosive gases generated in an engine.

These objects and others should be obvious from reading this specification and viewing the drawing wherein.

Figure 1:
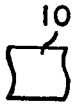
FIG. 1 is a cylindrical blank cut from a source of inconel wire.

The method of manufacturing an electrode for a spark plug is illustrated by the various steps set forth in the drawings of which FIG. 1 illustrates a piece of corrosion resistant metal wire having a dimension of about 0.139×0.2" which is cut from a spool or rod. The preferred metal wire is a corrosion resistant alloy of iron containing nickel and chromium generally known as inconel. One such inconel metal is known as Hoskins Alloy 831 and contains 75% nickel, 15% chromium and 7% iron.

Before placing a piece of inconel wire 10 into a die it should be coated with a standard cold heading lubricant. Such a lubricant is an oil with extreme pressure additives; sulphur, chlorine and neutral animal fat. It is most often a combination of sulphurized fat and a chlorine additive and is available from a good number of lubricant manufacturers. Lubrication is vital in cold heading to reduce die wear, promote good finishes and eliminate galling, scratching and seizing of the work piece by preventing pickups by the die. During the cold heading operation, the sulphur and chlorine components of the lubricant form ferrous sulphides and chlorides which prevent welding of the die to the work piece and act in the same way as a solid lubricant. An example of one such lubricating oil is TUF-DRAW 21334 made by the Franklin Oil Corporation of Ohio.

Figure 2:
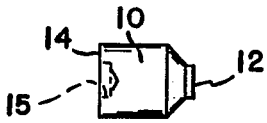
FIG. 2 is a view of the cylindrical blank of FIG. 1 which has been extruded to define a tip on a first end and an indentation on a second end.
Figure 3:
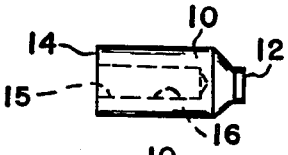
FIG. 3 is a view of the blank of FIG. 2 wherein the indentation has been elongated by a further extrusion step.
Figure 4:
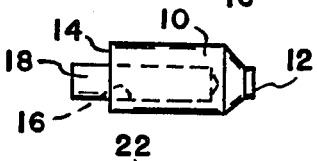
FIG. 4 is a view of the blank of FIG. 3 with a copper core inserted into the cup defined by the indentation.
Figure 5:
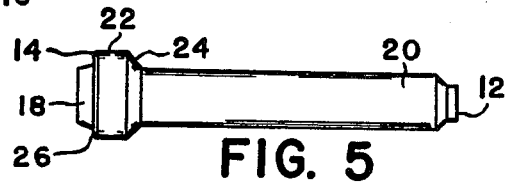
FIG. 5 is a view of the blank of FIG. 4 which has been extruded to a final desired length to define a center wire.
Figure 6:
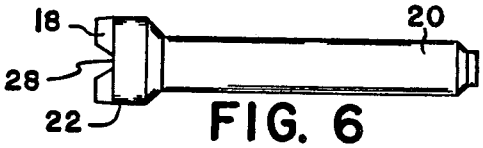
FIG. 6 is a view of the center wire of FIG. 5 with cross slot formed in the copper core center.

After the wire 10 is cut into a blank as shown in FIG. 1 and lubricated, it is taken to a first die where the first 12 and second 14 ends are squared to define flat surfaces and end 12 is extruded to produce a tip while an indentation 15 is formed in end 14 as shown in FIG. 2. The cylindrical blank 10 is transported to a second die and further extruded to develop a center bore 16 that extends from indentation 15, as shown in FIG. 3. After a copper core 18 is inserted in bore 16, as shown in FIG. 4, the cylindrical blank 10 is transported to a third die and further extruded to a predetermined length as shown in FIG. 5 to produce a center wire 20. Center wire 20 has a shoulder 22 with a tapered surface 24 and a lip 26.

The center wire 20 is removed from the third die and carried to a station where cross 28 is formed into the copper core 18 to complete its manufacture. A center wire 20 manufactured according to the procedure set forth above could be inserted into the porcelain or ceramic body 30 of a prior art spark plug 32 of a type shown in FIG. 16. This type center wire 20 would adequately perform under most operating conditions and meet the life requirements for current automobiles.

Figure 7:
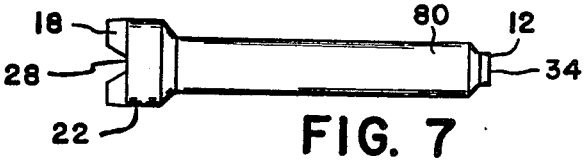
FIG. 7 is a view of the center wire of FIG. 6 showing the axial center having the tip of the first end.
Figure 8:
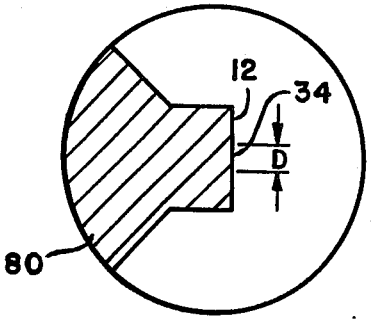
FIG. 8 is an enlarged sectional view of the tip on the first end of the center wire in FIG. 7.

The center wire 20 is further developed according to the disclosure of this invention by being transported to a fourth die where the axial center 34 of the tip of the first end 12 is identified to produce a center wire 80 as shown in FIGS. 7 and 8. The axial center 34 in normally a mark but could be an indentation. If an indentation is made on the tip it should not exceed between 25 to 40 percent of the diameter "D" of a sphere of platinum 36 which is metalurgically bonded thereto at another station. Such indentation in addition to help aligning the sphere 36 in substantially the axial center of the center wire 80 may provide aid in providing a larger initial surface area for the flow of current to produce the metalurgical bond.

Such indentation in the center wire 80 could be placed on the tip during any of the expansion steps illustrated in FIGS. 2–6.

Prior to the center wire 80 being transported to the station illustrated by FIG. 9, at least the tip on the first end 12 of the center wire 80 is passed through a cleaning station where oil and any oxides thereon are removed which may effect the later development of a metalurgical bond with the platinum sphere 36.

The platinum sphere 36 which is located in head 38 of a welding apparatus has a diameter 0.030 inches (0.0076 cm). The diameter of the sphere 36 of platinum could conceivable be as small as 0.020 inches (0.051 cm) and as large as 0.050 inches (0.127 cm). However, with the market price of platinum and the least amount of platinum needed to protect the underlying inconel should be selected.

Figure 9:
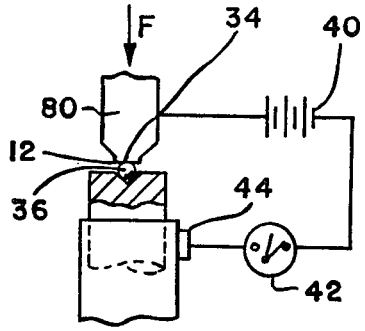
FIG. 9 is a sectional view of the center wire of FIG. 7 located in a fixture with the axial center on the tip positioned over a sphere of platinum.

The welder located at the station illustrated in FIG. 9, is state of the art sold by The Taylor-Winfield Corporation of Warren, Ohio and identified as Model No.E-BA-1 1/2.

The axial center 34 of tip on the end 12 of center electrode 80 is located over the sphere 36 of platinum. Switch 42 allows electrical current from a source 40 to flow to contact 44, through the sphere 36 of platinum into the center electrode 80 of inconel and back to ground. As electrical current is flowing a compressive force "F" is placed on the center electrode 80 to form a mechanical connection at the axial center 34 and sphere 36.

From experiments the following welding parameters were found to be satisfactory: the compressive "F" on the center electrode 80 could vary from about 9–25 pounds while the electrical current could vary from 500 to 1500 amps.

Figure 10:
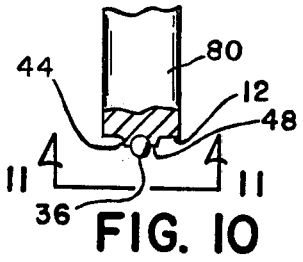
FIG. 10 is an enlarged view of the junction of the center wire and sphere of FIG. 9 after electrical current and pressure have caused the center wire to melt and flow over the sphere.
Figure 11:
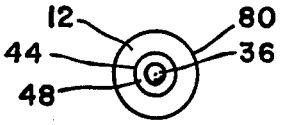
FIG. 11 is a view taken along line 11—11 of FIG. 10.

The flow of electrical current across the mechanical connection or junction creates thermal energy sufficient to melt the inconel adjacent the axial center 34. Gravity causes the melted inconel to flow and form a ring 44 around the sphere 36 in a manner illustrated in FIG. 10. When at least one-half of the sphere is coated with inconel, the switch 42 interrupts the flow of electrical current from source 40 and the force "F" is removed. The flow of inconel around the sphere forms a metalurgical bond that is equal to approximately one-half the total surface area of the sphere 36. As best seen in FIG. 11, the sphere 36 is located in the axial center of the tip of end 12 of electrode 80. For some applications, the protrusion of the sphere 36 above the tip of end 12 will be acceptable, however, for most general applications, it is desirable to increase the surface area of protection over a larger area of the tip. As a result, the electrode 80 is thereafter transported to a station where a compressive force is applied to flatten the sphere 36 in a manner illustrated by the sectional view in FIG. 12 and end view in FIG. 13.

Figure 12:
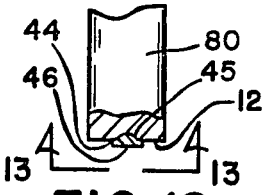
FIG. 12 is a sectional view of the center electrode with the sphere of platinum flatten to cover a larger area of the tip of the first end.
Figure 13:
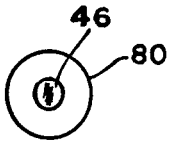
FIG. 13 is a view taken along line 13—13 of FIG. 12.

As can be seen in FIG. 12, the force applied to flatten the platinum, about 500 pounds (1100 kg), causes the ring 44 to fold back on itself. Disc 46 overs approximately one-half the diameter of the tip on end 12 while a dome 45 completely fills an indentation formed along the axial center of the center electrode 80.

Figure 15:
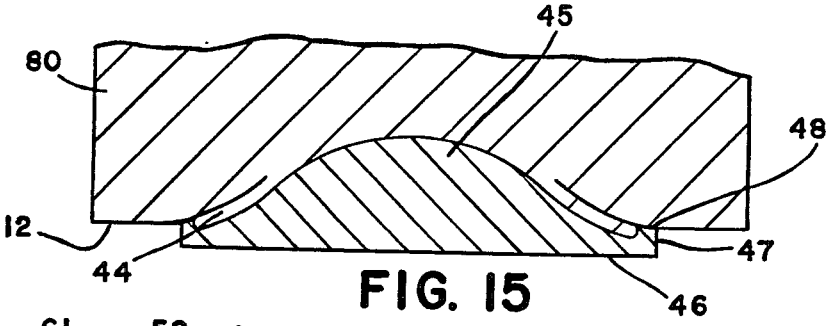
FIG. 15 is a sectional view of a side electrode with a sphere of platinum metalurgically bonded thereto.

FIG. 15 is a schematic illustration of a sectional view of an actual center wire electrode 80 with a flatten disc of platinum 46. The diameter of the disc 46 extended past the edge of tip 48 to provide protection for ring 44. Although, the ring of inconel 44 has been compressed into the end 12, the platinum disc 46 forms a uniform surface on the tip for the flow of electrical current. The thickness of the platinum at the edge 47 was measured as 0.002–0.006 inches while the diameter of the disc was 0.05–0.06 inches. Thus, it should be evident that a sphere of platinum can provide approximately twice the surface area coverage as its initial diameter.

Figure 17:
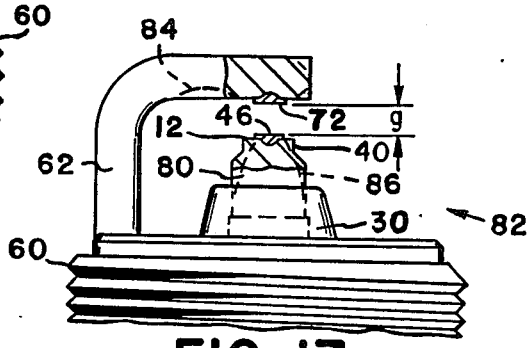
FIG. 17 is an enlarged view of a spark plug showing the relationship between the side and center wire electrodes made according to the principals of this invention.

Thereafter, the center electrode wire 80 was installed in a ceramic insulator 30 and fixed in a metal shell 60 as shown in FIG. 17.

Figure 14:
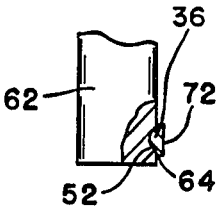
FIG. 14 is a sectional view of a photograph of a center electrode.

The development of the side wire electrode 62 shown in FIG. 14 follows the same process of welding a sphere of platinum to an inconel member. The side wire 62 is welded to the metal shell 60 and the center thereafter located over a platinum sphere 36 where electrical current and pressure are simultaneously applied thereto. The generation of thermal energy causes a ring of inconel 64 to flow around the sphere 36 and define a metalurgical bond. When at least one-half of the sphere 36 was coated with inconel, the current was terminated and the compressive force removed. Thereafter, a die was brought into engagement with the sphere and flattened the sphere 36 to establish disc 72 and dome 72 which fills indentation 52. Thereafter, the center wire 80 is located in a ceramic member 30 located in metal shell 60 to complete the manufacture of spark plug 82.

Figure 16:
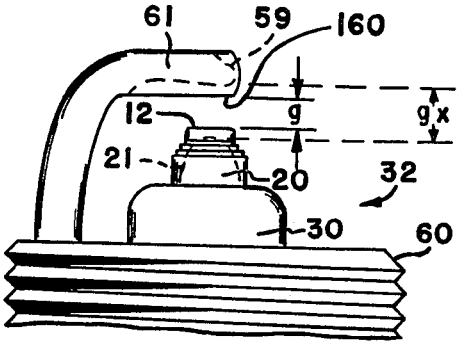
PRIOR ART FIG. 16
FIG. 16 is an enlarged view of a prior art spark plug showing the relationship between the side and center wire electrodes.

In order to evaluate spark plug 82, a standard spark plug 32 shown in FIG. 16 was tested for 750 hours of operation to simulate engine parameters. Before the test began, the gap "g" between the face 160 of the side electrode 60 and the tip 12 on the end of electrode 20 was set in accordance with engine specifications. At the end of the test period, the combustive gases and operation had eroded the side wire 61 in manner shown by dashed line 59 and the center wire in a manner shown by dashed line 21. As can be seen the gap had changed from "g" to "gx". For most operations, this type change in the spark gap would be unsatisfactory since the engine would not pass set operational standards.

Spark plug 82 shown in FIG. 17 was tested under the same operating condition as spark plug 32. Since platinum in unaffected by the combustive gases, at the end of the operating period while side wire 62 had eroded in a manner shown by dashed line 84 and center wire 80 had eroded as illustrated by dashed line 86, the gap "g" between disc surfaces 46 and 72 had not changed a measurable amount. Thus, a spark plug 82 manufactured by the process disclosed herein should be capable of operating for substantially the life of a vehicle.

I claim:

1. A method of manufacturing electrodes for a spark plug comprising the steps of:

cutting a first piece of inconel wire from a source to define a cylindrical blank having a first end and a second end;

placing said cylindrical blank in a first die, said first die forming an extruded tip on said first end;

placing said cylindrical blank in a second die, said second die forming an extruded cup in said cylindrical blank that extends from said second end toward said first end;

inserting a copper core in said cup;

placing said cylindrical blank and copper core in a die to extrude to predetermined length between said first and second end for a resulting center wire;

locating the axial center of said tip;

placing a first sphere of platinum from a source in a fixture;

positioning the axial center on said tip over said first sphere of platinum;

applying a compressive force to said center wire while applying electrical current to the center wire and first sphere of platinum, said electrical current causing thermal energy to be created at the junction of the axial center and first sphere, said thermal energy causing the inconel in the tip at the junction to melt and flow around said first sphere;

terminating the electrical current and compressive force when approximately fifty percent of said first sphere is covered with inconel; and transporting said center wire to a die where said first sphere of platinum is flattened into a first disc having a dome which is metalurgically bonded to the tip of said center electrode.

2. The method as recited in claim 1, whereby gravity causes the melted inconel to uniformly flow around the first sphere of platinum.

3. The method as recited in claim 2, whereby the compressive force applied to said center electrode varies from 9–25 pounds.

4. The method as recited in claim 3, whereby the electrical current applied to create said thermal energy varies from 530–1500 amps.

5. The method as recited in claim 4, wherein the time period required to coat the sphere with melted inconel is about 0.5 seconds.

6. The method as recited in claim 5, wherein said sphere of platinum has a diameter of approximately 0.030 inches.

7. The method as recited in claim 6, wherein an indentation is placed on said tip at the axial center, said indentation having a depth with a ratio to the diameter of the first sphere of platinum of about 1:4.

8. The method as recited in claim 1, further including:

cutting a second piece of inconel wire from said source;

placing said second piece of inconel wire in a die to establish a first surface on the side of said inconel wire;

locating the center of said first surface;

placing a second sphere from the source in the fixture;

placing said center of said first surface over said second sphere;

applying a compressive force while flowing electrical current through said second wire and second sphere of platinum, said electrical current causing thermal energy to be created at the junction of said first surface and second sphere, said thermal energy causing the inconel to flow around the second sphere; and terminating the compressive force and electrical current when approximately fifty percent of the second sphere is covered with inconel.

9. The method as recited in claim 8, further including the step of:

transporting said second wire to a die where said second sphere of platinum is flattened into a second disc having a dome metalurgically bonded to said first surface of said second wire to define a side electrode.

10. The method as recited in claim 9, further including the step of:

locating said center electrode in a ceramic fixture located in a metal shell;

attaching said second wire to said metal shell; and aligning said first and second disc to define a fixed gap between the tip of said center electrode and the first surface of said side electrode.

* * * * *